US007175744B2

(12) United States Patent
Bartelmuss et al.

(10) Patent No.: US 7,175,744 B2
(45) **Date of Patent: *Feb. 13, 2007**

(54) APPARATUS FOR TREATING A WIRE OR A FELT BAND IN A PAPERMAKING INSTALLATION

(76) Inventors: Klaus Bartelmuss, Teufenbach 63, A-8833 Teufenbach (AT); Heinz Bartelmuss, Teufenbach 63, A-8833 Teufenbach (AT)

( * ) Notice: Subject to any disclaimer, the term of this patent is extended or adjusted under 35 U.S.C. 154(b) by 485 days.

This patent is subject to a terminal disclaimer.

(21) Appl. No.: 10/682,639

(22) Filed: Oct. 9, 2003

(65) Prior Publication Data

US 2004/0163787 A1 Aug. 26, 2004

(30) Foreign Application Priority Data

Feb. 20, 2003 (AT) ..... A 257/2003

(51) Int. Cl.
*D21F 1/52* (2006.01)
*D21F 1/32* (2006.01)

(52) U.S. Cl. ..... 162/352; 162/274; 162/351; 162/363; 162/374

(58) Field of Classification Search ..... 162/351, 162/352, 354–356, 208, 209, 211, 199, 272, 162/274, 256, 257, 363, 374
See application file for complete search history.

(56) References Cited

U.S. PATENT DOCUMENTS

| | | | | |
|---|---|---|---|---|
| 1,917,098 | A * | 7/1933 | Cofrin | 162/209 |
| 2,124,028 | A * | 7/1938 | Charlton | 162/356 |
| 3,357,881 | A * | 12/1967 | Bennett | 162/354 |
| 3,585,105 | A * | 6/1971 | Stuebe | 162/211 |
| 3,741,866 | A * | 6/1973 | Jud et al. | 162/374 |
| 3,821,077 | A * | 6/1974 | Kaiser | 162/351 |
| 3,922,190 | A * | 11/1975 | Cowan | 162/352 |
| 4,191,612 | A * | 3/1980 | Araoka | 162/352 |
| 6,780,286 | B2 * | 8/2004 | Van Essen et al. | 162/352 |
| 6,875,313 | B2 * | 4/2005 | Bartelmuss et al. | 162/352 |

* cited by examiner

*Primary Examiner*—Eric Hug
(74) *Attorney, Agent, or Firm*—Laurence A. Greenberg; Werner H. Stemer; Ralph E. Locher

(57) ABSTRACT

An apparatus for the treatment of, in particular for vacuum action upon, the at least one wire or at least one felt band in a papermaking plant. The wire or felt band is moved in circulation by the apparatus, which, if appropriate, is connected to a vacuum source. The apparatus has a carrying device assigned to the wire or felt band and a multiplicity of supporting elements are disposed at a distance from one another.

18 Claims, 6 Drawing Sheets

APPARATUS FOR TREATING A WIRE OR A FELT BAND IN A PAPERMAKING INSTALLATION

BACKGROUND OF THE INVENTION

Field of the Invention

The invention lies in the papermaking field. More specifically, the invention pertains to an apparatus for the treatment of, in particular for vacuum action upon, the at least one wire (screen band) provided in a papermaking plant and moved in circulation or of the at least one felt band that is provided in a plant of this type. If appropriate, the apparatus has a vacuum source connected to it.

State of the art papermaking plants have a first plant part, wherein at least one wire (also referred to as a screen, a wire screen, or a screen band) produced from plastic is located, and a second plant part, wherein at least one felt band is located. The two bands are endless bands that are moved in circulation via guide rollers or deflecting rollers when the plant is in operation. The screen band has applied to it a paper pulp, from which the liquid contained in the latter is discharged, in particular sucked away, along the path of movement of the screen band. In further sequence, the paper web is transferred onto at least one following felt band, which absorbs residual moisture contained in the paper web.

Both the screen band and the felt band are treated by way of apparatuses that are disposed along their paths of movement. By way of a first group of apparatuses, the liquid which passes onto the underside of the screen band and has emerged from the paper web is stripped off. By way of further groups of apparatuses, the screen band or the felt band is acted upon by a suction force. These apparatuses are designed, on their top side facing the wire or the felt band, to be highly wear-resistant to the abrasion caused by the movement of the bands.

Prior art apparatuses of the type are constructed, in this context, with strips that are oriented transversely to the directions of movement of the screen band or felt band and that are formed of a highly wear-resistant material, for example of a ceramic material. The wire or the felt band come to bear against the strips.

Insofar as these apparatuses are assigned a vacuum source, there is the requirement to cause the suction action to take effect over as large an area as possible of the wire or felt band. In this case, the technical requirements contradict one another inasmuch as, on the one hand, the wire or the felt band is to be supported over as large an area as possible and, on the other hand, those areas of the wire or of the felt band on which the suction force takes effect are also to be as large as possible. Moreover, one object is to subject the wire and the felt band to tensile forces which act transversely to their directions of movement and by way of which the bands are stretched, with the result that it becomes easier to remove fibers, liquid and the like from them. Furthermore, turbulences which influence the paper quality are generated in the paper webs by these tensile loads.

SUMMARY OF THE INVENTION

It is accordingly an object of the invention to provide an apparatus for treating a wire or a felt screen in a papermaking installation which overcomes the above-mentioned disadvantages of the heretofore-known devices and methods of this general type. That is, the object of the present invention is to provide an apparatus, by means of which the conditions given above are satisfied to a much greater extent than is the case with prior art apparatuses which are configured, on their side facing the wire or the felt band, with strips extending transversely to the direction of movement of the bands.

With the foregoing and other objects in view there is provided, in accordance with the invention, an apparatus for treating a wire or a felt band in a papermaking plant, comprising:

a carrying device assigned to the wire or to the felt band; and said carrying device having a multiplicity of supporting elements disposed at a spacing distance from one another.

In accordance with a preferred embodiment, there is provided a vacuum source connected to act with vacuum upon the wire or felt band circulating by the carrying device.

In other words, the above and other objects are achieved, according to the invention, in that a carrying device assigned to the at least one wire or to the at least one felt band has a multiplicity of supporting elements arranged at a distance from one another.

Preferably, the supporting elements are designed, on their side facing the wire or the felt band, with rests which are wear-resistant with respect to the movement of the wire or the felt band. Furthermore, supporting elements may be adjustable with respect to the carrying device in terms of their distance from the wire or the felt band. In this case, supporting elements may be arranged on carrying strips adjustable with respect to the wire or the felt band, part of the supporting elements being fastened rigidly to the carrying device, and part of these being adjustable with respect to the carrying device. According to a preferred embodiment, the supporting elements are arranged next to one another on carrying strips oriented transversely to the direction of movement of the wire or of the felt band, preferably at least part of the carrying strips being adjustable with respect to the carrying device.

Preferably, that side of the carrying device which faces the wire or the felt band is provided with a rest which is wear-resistant with respect to the movement of the wire or of the felt band, the margins of the rest which face the supporting elements transversely to the direction of movement of the wire or felt band being designed with portions running at an acute angle to the direction of movement of the wire or felt band. In particular, in this case, the margins of the rest which run transversely to the direction of movement of the wire or of the felt band have a wavy design.

According to a further preferred embodiment, the carrying device is arranged so as to be adjustable transversely to the direction of movement of the wire or of the felt band, said carrying device being assigned a drive device, by means of which it can be oscillated transversely to the direction of movement of the wire or of the felt band. In this case, the carrying device may form part of a suction box, preferably the suction box being designed to be oscillatable transversely to the direction of movement by means of the drive device.

Furthermore, preferably, the supporting elements are designed as tubular pieces, into which are inserted, at their end facing the wire or the felt band, elements consisting of material which is wear-resistant with respect to the movement of the wire or of the felt band. In this case, the edges of the top sides of the elements, said top sides facing the wire or the felt band, may have a chamfered, in particular beveled or rounded, design, and these elements may be designed on the opposite sides with extensions by means of which they can be inserted into the tubular pieces. Furthermore, these elements may be designed with a surface convexly curved with respect to the wire or the felt band.

Other features which are considered as characteristic for the invention are set forth in the appended claims.

Although the invention is illustrated and described herein as embodied in an apparatus for the treatment of, in particular for vacuum action upon, the at least one wire provided in a papermaking plant and moved in circulation or of the at least one felt band provided in a plant of this type, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
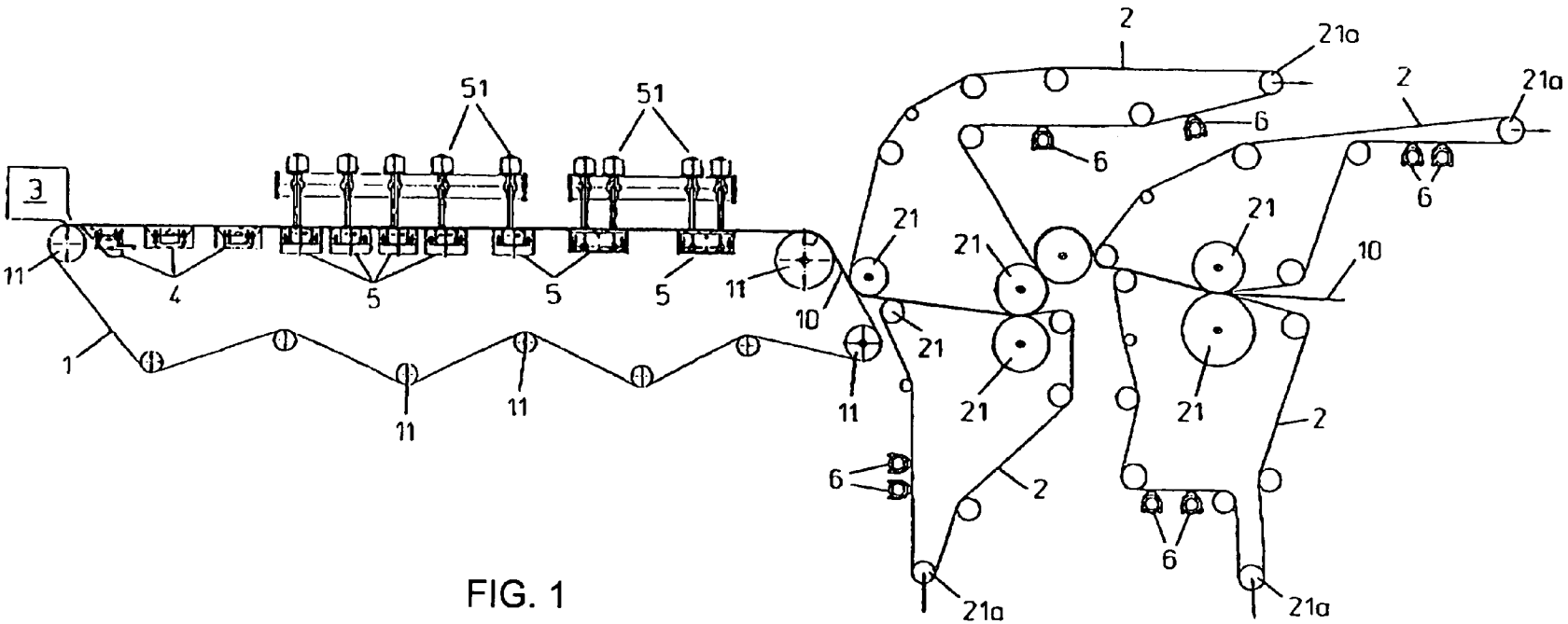
FIG. 1 is a diagrammatic illustration of a papermaking plant provided with apparatuses according to the invention.

Referring now to the figures of the drawing in detail and first, particularly, to FIG. 1 thereof, there is shown a plant or installation for producing a paper web 10. The plant is organized in two plant parts. A wire or screen 1 manufactured from a plastic being located in a first plant part and two pairs of felt bands 2 being located in a plant part which follows in the direction of movement of the paper web 10. The wire 1 is assigned a device 3, by means of which a paper pulp is sprayed onto the wire 1 over a width of a plurality of meters. The wire 1, which is closed on itself, can be moved in circulation via a plurality of deflecting or guide rollers 11. In the first region of the path of movement of the wire 1, downstream of the device 3 for spraying the paper pulp, the wire 1 is assigned three apparatuses 4 which are explained below with reference to FIG. 2A. In further sequence, the wire 1 is assigned a plurality of suction apparatuses 5 which are explained below with reference to FIG. 2B. The suction apparatuses 5 are designed with regulating devices 51, by way of which their operating mode is controlled.

The pairs of felt bands 2 located in the second plant part can likewise be moved in circulation by deflection rollers and guide rollers 21. The felt bands 2 are assigned suction apparatuses 6 which are explained below with reference to FIG. 2C. At least one in the respective group of guide and deflecting rollers is designed as a tension roller 21*a*.

Figure 2C:
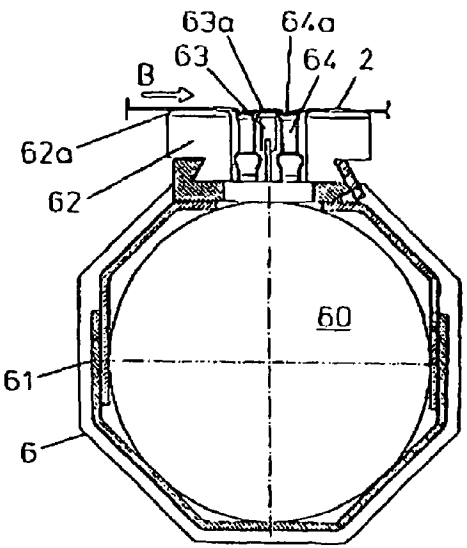
FIG. 2A, FIG. 2B, FIG. 2C illustrate three different embodiments of apparatuses according to the invention in a side view and in section.
Figure 2B:
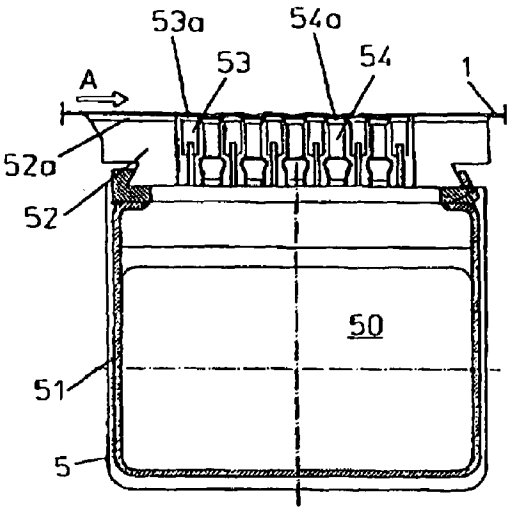
Figure 2A:
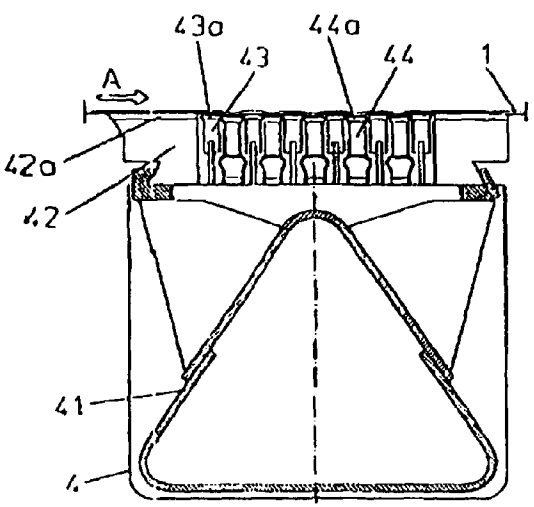

As is evident from FIG. 2A, the apparatuses 4 are designed, on their side facing the wire 1, with a carrying strip 41 of triangular cross section, on which is located a carrying frame 42 for a multiplicity of supporting elements 43 and 44 arranged next to one another in the direction of movement A of the wire 1 and transversely to this. The carrying frame 42 is fastened releasably to the carrying strip 41. The supporting elements 43 are fastened rigidly to the carrying frame 42, whereas the supporting elements 44 are adjustable with respect to the carrying frame 42 in terms of their height in relation to the wire 1. Both the frame 42 and the supporting elements 43 and 44 are designed, on their side facing the wire 1, with rests 42*a*, 43*a* and 44*a* consisting of a highly wear-resistant material, in particular of a ceramic material.

As is evident from FIG. 2B, the suction apparatuses 5 consist of a housing 51 which extends over the width of the wire 1 withwherein is located a duct 50 to which a vacuum source is connected. Likewise arranged on the side facing the wire 1 is a carrying frame 52, withwherein are located fixedly arranged supporting elements 53 and adjustable supporting elements 54. The carrying frame 52 is likewise fastened releasably to the housing 51. The carrying frame 52 and the supporting elements 53 and 54 are also designed with rests 52*a*, 53*a* and 54*a* which consist of a highly wear-resistant material, in particular of a ceramic material, and against which the wire 1 comes to bear. The direction of movement of the wire 1 is indicated by the arrow A.

As is evident from FIG. 2C, the apparatuses 6 consist of a tubular housing 61 which extends over the width of the felt bands 2 and withwherein is located a duct 60 to which a vacuum source is likewise connected. Located on that side of this housing 61 which faces the felt band 2 is a carrying frame 62 which is fastened releasably to the housing 61 and withwherein are located fixedly arranged supporting elements 63 and supporting elements 64 adjustable with respect to the felt band 2. Both the carrying frame 62 and the supporting elements 63 and 64 are designed with rests 62*a*, 63*a*, 64*a* consisting of a highly wear-resistant material, in particular of a ceramic material. The direction of movement of the felt band 2 is indicated by the arrow B.

Figure 3B:
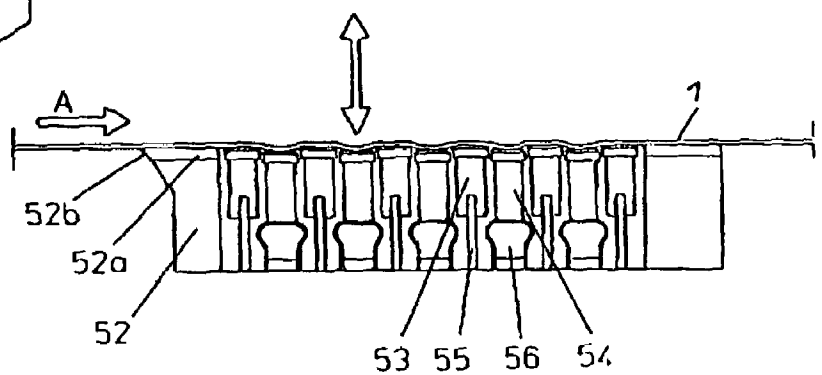
FIG. 3B is a side view thereof.
Figure 3A:
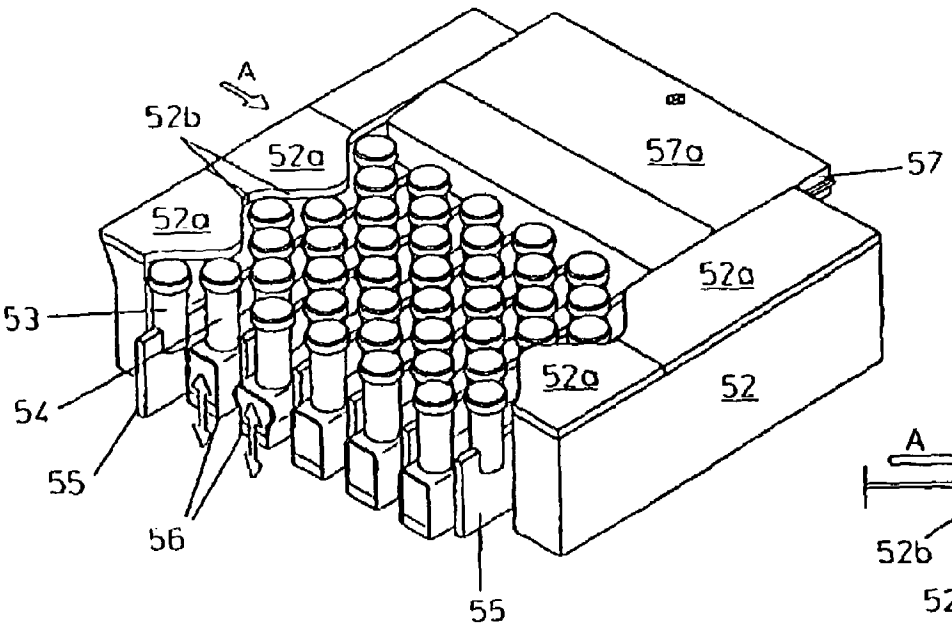
FIG. 3A is a perspective view of a fourth embodiment of an apparatus according to the invention.

As is evident from FIGS. 3A and 3B, in the case of the suction apparatus 5, the carrying frame 52 has located within it carrying strips 55, which are arranged rigidly on the latter and to which the nonadjustable supporting elements 53 are fastened, and also carrying strips 56, which are adjustable in terms of their distance from the top side of the carrying frame 52 and to which the adjustable supporting elements 54 are fastened. Furthermore, the inner margins 52*b* of the rests 52*a* are provided, transversely to the direction of movement A of the wire 1, with portions running at an acute angle, said portions having, in particular, a design in the form of a wavy line. Moreover, the carrying frame 52 is designed, on its sides assigned to the regions of the margins of the wire 1, with parts 57 which are adjustable transversely to these and by means of which the size of the suction orifice can be set. These parts 57, too, are provided with highly wear-resistant rests 57*a*.

As is likewise evident from FIG. 3B, furthermore, the front edge of the rest 52*a*, in the direction of movement A of the wire 1, is formed with a wedge-shaped extension 52*b*, by means of which the stripping-off action of the apparatus 5 is improved.

By virtue of the different heights of the supporting elements 53 and 54, the wire 1 is moved in a wavy manner during its movement over the supporting elements 53 and 54, with the result that it is subjected to tensile loads. Furthermore, by means of the margins 52*b* in the form of a wavy line, the wire 1, during its movement over the carrying frame 52, is subjected to tensile loads acting in the plane of the latter transversely to the direction of movement A. Both of these tensile loads have the effect that the impurities and liquids located in the wire 1 can be removed from the latter more easily, so that it becomes easier for liquid to flow out of the paper pulp. As a result of this, moreover, the action of the suction forces exerted on the wire 1 is decisively improved. In addition, turbulences which influence the quality of the paper web are generated in the paper web by means of these tensile loads.

The carrying frame 42 of the apparatus 4 according to FIG. 2 has the same construction, even though no vacuum source is connected to this apparatus.

Figure 4B:
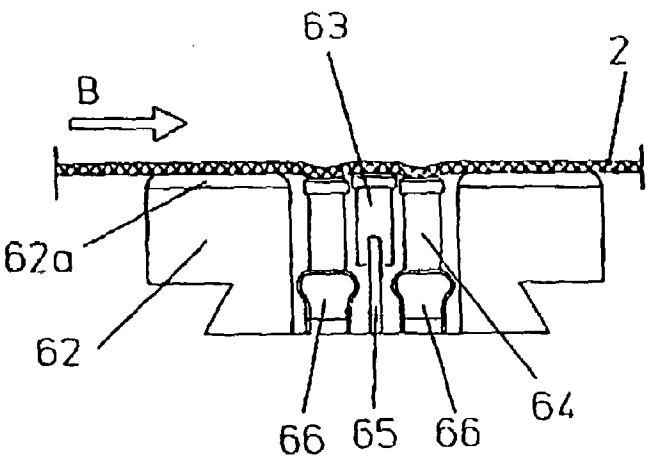
FIG. 4B is a side view thereof.
Figure 4A:
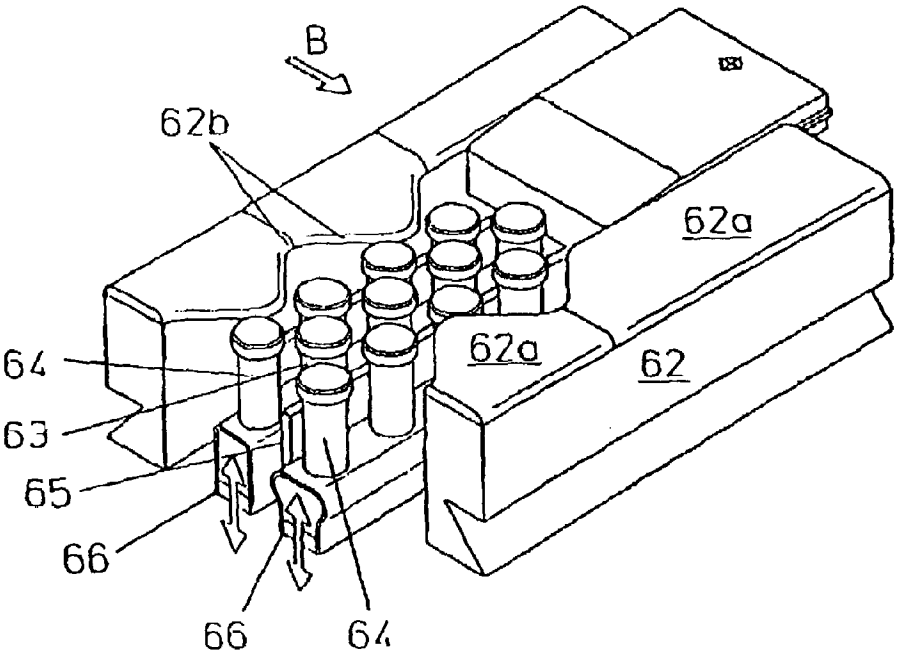
FIG. 4A is a perspective view of a fifth embodiment of an apparatus according to the invention.

As is evident from FIGS. 4A and 4B, the suction apparatuses 6 assigned to the felt band 2 have a similar construction. In this case, too, the carrying frame 62 has located within it fixed carrying strips 65 with supporting elements 63 and carrying strips 66 adjustable with respect to the felt band 2 and having adjustable supporting elements 64, and the margins 62*b* of the rests 62*a* are designed in the form of a wavy line transversely to the direction of movement B of the felt bands 2. As a result of the tensile loads thereby exerted on the felt bands 2, the latter are stretched in a plurality of directions during their movement over the suction apparatuses 6, with the result that impurities and liquids contained in these felt bands are removed more easily and the action of the suction force exerted on the felt bands 2 is increased. Insofar as the margins 62*b* run at an increasing distance from one another with respect to the longitudinal axis of the felt band 2, tensile forces oriented transversely to the direction of movement of the felt bands 2 are thereby exerted on the latter, with the result that creasing in the felt bands 2 is prevented. This effect also applies to the identically designed margins of the apparatuses 4 and 5 with regard to the wire 1.

Figure 5:
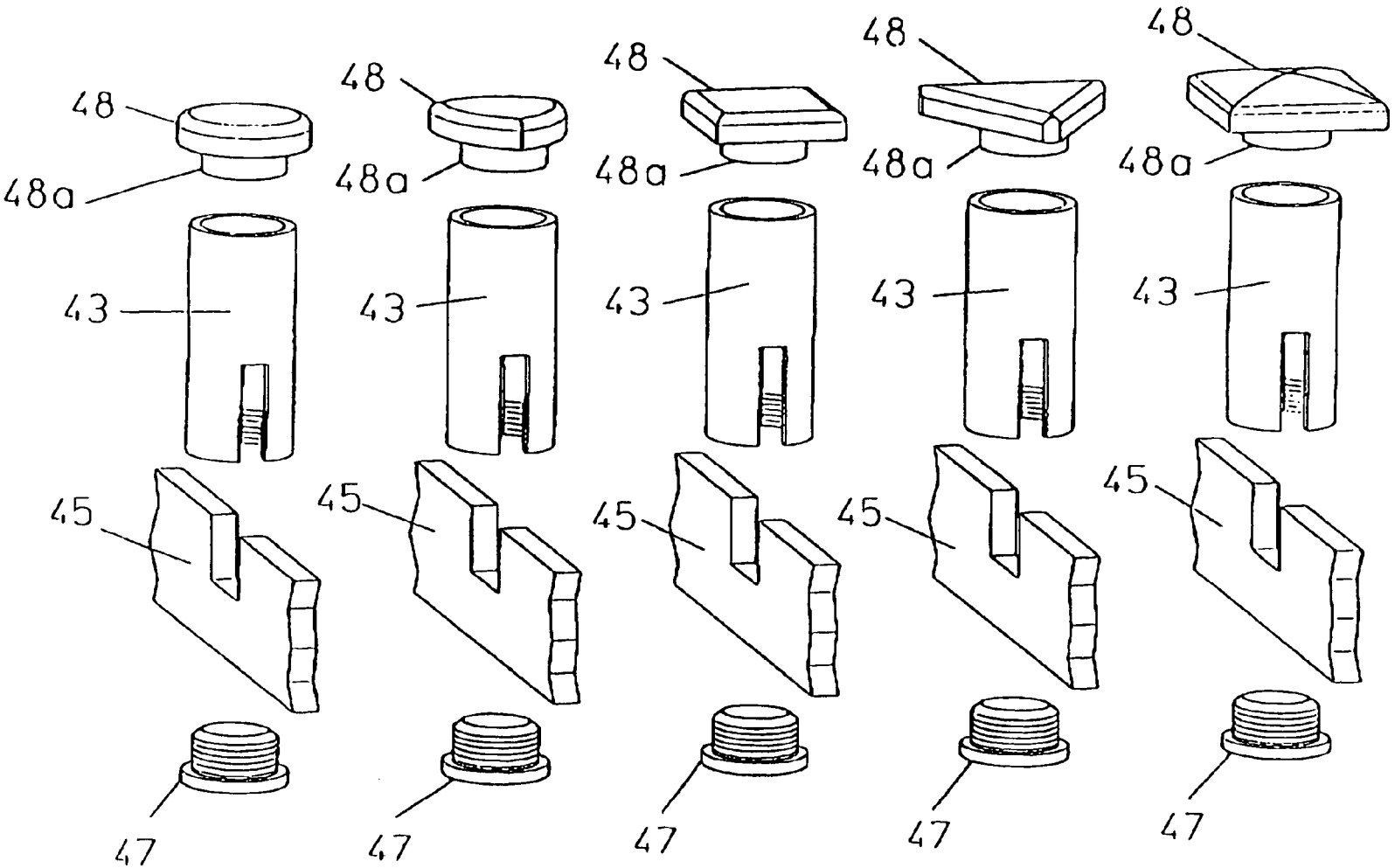
FIG. 5 is a selection of perspective views of five differently configured supporting elements.

As is evident from FIG. 5, the supporting elements 43 may be configured as tubular pieces which are placed onto the carrying strips 45 by means of slots assigned to one another, said supporting elements being fastened on the carrying strips 45 by means of a screw element 47. A cap 48 is inserted into that end of the tubular pieces which faces the wire 1 or the felt band 2. For this purpose, the caps 48 are designed with cylindrical extensions, by means of which they are inserted into the tubular pieces. The caps 48 are produced from a highly wear-resistant material, in particular from a ceramic material. In this case, the caps 48 may have different three-dimensional configurations. In particular, they may be chamfered, in particular beveled, or rounded. Moreover, these caps 48 may be designed to be curved with respect to the wire 1. The movable supporting elements 44 and also the supporting elements 53 and 54 and the supporting elements 63 and 64 may be designed in the same way and be fastened on fixed or adjustable carrying strips.

Figure 6B:
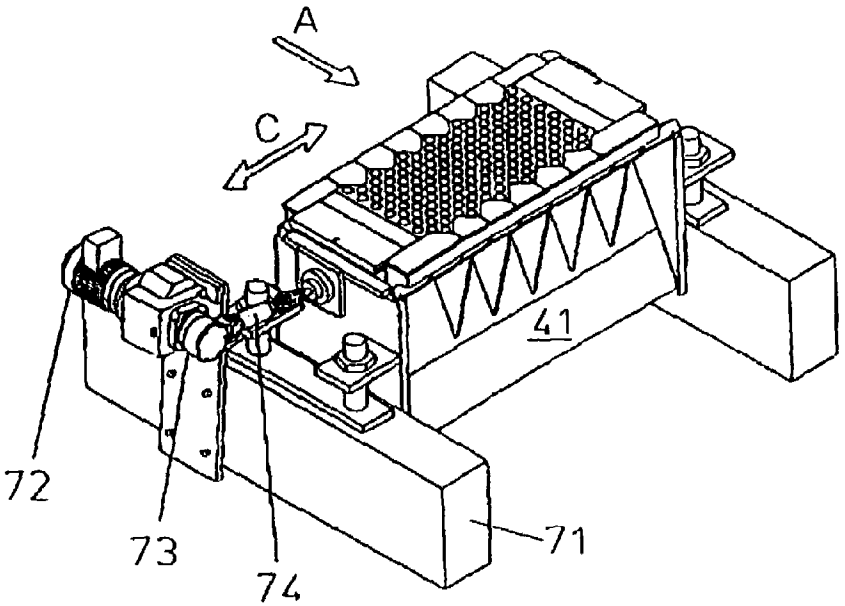
FIG. 6B is a perspective view of a further embodiment of such an apparatus.
Figure 6A:
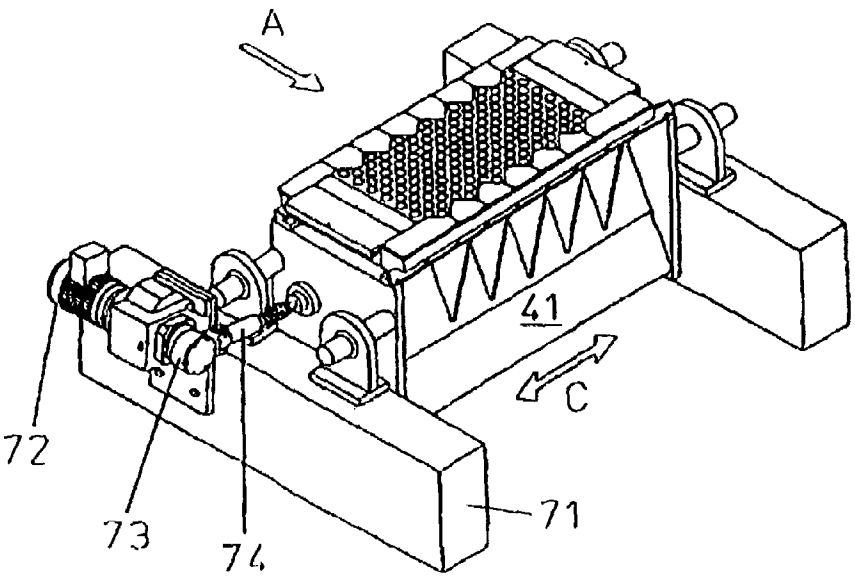
FIG. 6A is a perspective view of an apparatus according to the invention which can execute oscillating movements transversely to the direction of movement of the wire or of the felt band.

As is evident from FIG. 6A, and this also applies to the apparatuses 5 and 6, the housing 41 of the apparatus 4 may be displaceable on a carrying stand 71 back and forth in the direction of the double arrow C transversely to the directions of movement A and B of the wire 1 or of the felt bands 2, said housing being assigned a servomotor 72, by means of which it can be acted upon by oscillating movements via an eccentric shaft 73 and a push rod 74.

Alternatively to this, as illustrated in FIG. 6B, the carrying frame 42 is mounted on the housing 41 so as to be displaceable back and forth in the direction of the double arrow C, said carrying frame having oscillating movements C imparted to it transversely to the directions of movement A of the wire 1 by the drive motor 72 via the eccentric shaft 73 and the push rod 74. The carrying frames 52 and 62 may also be mounted in the same way so as to be displaceable transversely to the directions of movement A and B of the wire 1 or of the felt bands 2.

By means of oscillating movements of this kind of the carrying frames and of the supporting elements, the wire 1 or the felt bands 2 are subjected to an increased extent to tensile loads acting in a plurality of directions, with the result that their actions, in particular their suction actions, are further increased.

We claim:

1. An apparatus for treating a wire or a felt band in a papermaking plant, comprising:

a carrying device assigned to the wire or to the felt band; and said carrying device having a multiplicity of supporting elements disposed at a spacing distance from one another;

wherein said supporting elements are tubular pieces with ends facing the wire or felt band and having wear resistant elements inserted into the ends facing the wire or felt band.

2. The apparatus according to claim 1, which comprises a vacuum source connected to act with vacuum upon the wire or felt band circulating by said carrying device.

3. The apparatus according to claim 1, wherein said supporting elements are configured, on a side thereof facing the wire or the felt band, with rests formed of wear-resistant material with respect to a movement of the wire or the felt band.

4. The apparatus according to claim 1, wherein said supporting elements are adjustable with respect to said carrying device with regard to a distance thereof from the wire or the felt band.

5. The apparatus according to claim 4, which comprises carrying strips adjustably disposed with respect to the wire or the felt band and carrying said supporting elements.

6. The apparatus according to claim 4, wherein some of said supporting elements are rigidly fastened to said carrying device, and some of said supporting elements are adjustably supported with respect to the carrying device.

7. The apparatus according to claim 4, wherein said supporting elements are disposed next to one another on carrying strips oriented transversely to a direction of movement of the wire or of the felt band.

8. The apparatus according to claim 7, wherein some of said supporting elements are adjustably mounted to said carrying devices.

9. The apparatus according to claim 1, wherein the wire or felt band circulates by said carrying device during an operation of the apparatus, and said carrying device is adjustably mounted transversely to a direction of movement of the wire or of the felt band, and wherein a drive device is connected to said carrying device for oscillating said carrying device transversely to the direction of movement of the wire or the felt band.

10. The apparatus according to claim 1, wherein said carrying device forms part of a suction box.

11. The apparatus according to claim 10, wherein said suction box is mounted for oscillation transversely to a direction of movement of the wire or felt band, and a drive device is connected to said suction box for oscillating said suction box.

12. The apparatus according to claim 1, wherein said elements are formed of a material that is wear-resistant with respect to a movement of the wire or felt band.

13. The apparatus according to claim 1, wherein top sides of said elements have edges facing the wire or felt band, and the edges are chamfered or rounded design, and said elements are formed, on opposite sides, with extensions for insertion into said tubular pieces.

14. The apparatus according to claim 13, wherein said edges are beveled.

15. The apparatus according to claim 1, wherein said elements are formed with a convexely curved surface with respect to the wire or felt band.

16. An apparatus for treating a wire or a felt band in a papermaking plant, comprising:

a carrying device assigned to the wire or to the felt band, the wire or felt band circulating by said carrying device during an operation of the apparatus, and a rest that is wear-resistant with respect to a movement of the wire or felt band being disposed on a side of said carrying device facing the wire or felt band, said carrying device having a multiplicity of supporting elements disposed at a spacing distance from one another, and said rest having margins facing said supporting elements transversely to the direction of movement of the wire or of the felt band formed with portions running at an acute angle to the direction of movement of the wire or the felt band.

17. The apparatus according to claim 16, wherein said margins of said rest which run transversely to the direction of movement of the wire or felt band have a wavy configuration.

18. An apparatus for treating a wire or a felt band in a papermaking plant, comprising:

a carrying device disposed to support the wire or the felt band and having a multiplicity of supporting elements formed with ceramic material disposed to support the wire or the felt band and configured to remove a liquid from an underside of the wire or felt band;

said supporting elements being disposed at a spacing distance from one another in a direction of movement and transversely to the direction of movement of the wire or the felt band and forming intermediate spaces therebetween; and a vacuum source connected to create a vacuum at said carrying device, with said intermediate spaces between said supporting elements forming substantially vertical flow channels for fluids suctioned through the wire or the felt band.

* * * * *